US010945480B2

(12) United States Patent
Romanski et al.

(10) Patent No.: US 10,945,480 B2
(45) Date of Patent: Mar. 16, 2021

(54) FACEMASK AFFIXED TO A BASEBALL CAP

(71) Applicants: Douglas Romanski, Milford, MI (US); Mark Barrett, Byron, MI (US); Kirk Schultz, Walled Lake, MI (US)

(72) Inventors: Douglas Romanski, Milford, MI (US); Mark Barrett, Byron, MI (US); Kirk Schultz, Walled Lake, MI (US)

( * ) Notice: Subject to any disclaimer, the term of this patent is extended or adjusted under 35 U.S.C. 154(b) by 139 days.

(21) Appl. No.: 16/152,473

(22) Filed: Oct. 5, 2018

(65) Prior Publication Data

US 2019/0037948 A1 Feb. 7, 2019

Related U.S. Application Data

(63) Continuation-in-part of application No. 15/044,724, filed on Feb. 16, 2016, now abandoned, which is a continuation-in-part of application No. 13/948,973, filed on Jul. 23, 2013, now abandoned.

(60) Provisional application No. 61/674,839, filed on Jul. 23, 2012.

(51) Int. Cl.

| | |
|---|---|
| ***A42B 1/00*** | (2006.01) |
| ***A42B 1/24*** | (2006.01) |
| ***A41G 7/00*** | (2006.01) |
| ***A42B 1/004*** | (2021.01) |
| *A63B 71/10* | (2006.01) |

(52) U.S. Cl.

CPC ..... *A42B 1/004* (2013.01); *A42B 1/24* (2013.01); *A63B 71/10* (2013.01)

(58) Field of Classification Search

CPC ..... A42B 1/004; A42B 1/24; A41D 13/11; A41G 7/00; A63B 71/10; A63B 2071/05

USPC ..... 2/206

See application file for complete search history.

(56) References Cited

U.S. PATENT DOCUMENTS

| | | | | | |
|---|---|---|---|---|---|
| 1,514,111 | A | * | 11/1924 | Sutton | A42B 1/247 2/10 |
| 2,248,331 | A | * | 7/1941 | Blodjer | A42B 1/062 2/10 |
| 2,362,597 | A | * | 11/1944 | Vince | A63B 71/10 2/9 |
| 4,173,795 | A | * | 11/1979 | Lundin | A63B 71/10 2/425 |
| D318,747 | S | * | 7/1991 | Barker | D29/106 |
| 5,171,152 | A | * | 12/1992 | McCleery | A63B 69/3608 473/210 |
| 5,184,354 | A | * | 2/1993 | Alfaro | A61F 9/02 2/425 |

(Continued)

*Primary Examiner* — Alissa L Hoey
(74) *Attorney, Agent, or Firm* — Brooks Kushman P.C.

(57) ABSTRACT

A one-piece facemask in combination with a ball cap including a bill. The facemask includes a grid portion formed by a plurality of interconnected plastic segments with circular cross sections joined at substantially perpendicular angles. One of the segments forms an upper edge of the grid portion spanning from a distal left side of the grid portion to a distal right side of the grid portion. The facemask includes one plastic bar spanning the upper edge of the grid portion. The one plastic bar is unconnected to the upper edge of the grid portion between the distal left side of the upper edge of the grid portion and the distal right side of the upper edge of the upper edge of the grid portion to define an open slot between the elongated bar and the upper edge of the grid portion. The open slot receives the bill of the ball cap.

9 Claims, 9 Drawing Sheets

(56) References Cited

U.S. PATENT DOCUMENTS 5,206,955 A * 5/1993 Milligan ..... A42B 3/20 2/424
D338,546 S * 8/1993 Barker ..... D2/870
5,335,371 A * 8/1994 Spessard ..... A63B 71/10 2/11
5,477,565 A * 12/1995 Hunt, Jr. ..... A42B 3/20 2/423
5,661,849 A * 9/1997 Hicks ..... A42B 3/20 2/424
5,662,509 A * 9/1997 Lieberman ..... A63H 3/06 446/220
5,806,088 A * 9/1998 Zide ..... A42B 3/20 2/424
5,991,927 A * 11/1999 Barbaccia ..... A42B 1/24 2/209.13
6,401,258 B1 * 6/2002 Wilson ..... A42B 1/02 2/410
6,499,139 B1 * 12/2002 Brown ..... A42B 3/20 2/9
6,558,266 B2 * 5/2003 McMahon ..... A63B 69/3608 33/262
6,584,614 B2 * 7/2003 Hogg ..... A42B 1/247 2/10
6,708,339 B1 * 3/2004 Smith, Jr. ..... A42B 3/20 2/425
6,854,128 B1 * 2/2005 Faulk ..... A45D 44/22 2/171.2
7,097,080 B2 * 8/2006 Cox ..... A42B 1/002 223/14
7,103,920 B1 * 9/2006 Otterson ..... A42B 1/247 2/195.1
D559,502 S * 1/2008 Lanphere, Jr. ..... D2/870
7,430,763 B1 * 10/2008 Santos ..... A42B 3/20 2/424
7,490,359 B2 * 2/2009 Landis ..... A41D 13/1184 128/857
D654,227 S * 2/2012 Stout ..... D29/111
D677,204 S * 3/2013 Perez ..... D12/193
D690,471 S * 9/2013 Richey ..... D29/110
8,567,021 B2 * 10/2013 McCabe ..... A42B 1/004 2/200.1
8,973,166 B1 * 3/2015 Engle ..... A42B 1/063 2/175.1
9,504,286 B2 * 11/2016 Sussmann ..... A42B 3/0406
D778,034 S * 2/2017 Chapman ..... D2/831
2003/0226861 A1 * 12/2003 Frey ..... A45C 11/02 223/14
2004/0055071 A1 * 3/2004 Miska ..... A42B 1/208 2/171
2005/0174532 A1 * 8/2005 Wichner ..... A42B 1/247 351/155
2006/0206976 A1 * 9/2006 Futch ..... A42B 3/20 2/9
2007/0266471 A1 * 11/2007 Lin ..... A42B 3/20 2/9
2008/0141438 A1 * 6/2008 Reitz ..... A42B 1/004 2/206
2009/0044316 A1 * 2/2009 Udelhofen ..... A42B 3/20 2/424
2009/0083891 A1 * 4/2009 Cote ..... A42B 3/20 2/9
2009/0106883 A1 * 4/2009 Wade ..... A42B 3/20 2/424
2009/0119819 A1 * 5/2009 Thompson ..... A42B 1/002 2/209.13
2010/0011476 A1 * 1/2010 Kavanagh ..... A42B 3/20 2/9
2011/0131710 A1 * 6/2011 Maddux ..... A42B 3/20 2/424
2011/0247181 A1 * 10/2011 Lin ..... A42B 3/20 24/455
2012/0137413 A1 * 6/2012 DeBoer ..... A42B 3/18 2/424
2013/0145525 A1 * 6/2013 Arenson ..... A42B 1/061 2/424
2013/0180031 A1 * 7/2013 Bullock ..... A42B 1/067 2/209.13
2013/0305431 A1 * 11/2013 Mraz ..... A42B 1/00 2/173
2014/0020153 A1 * 1/2014 Romanski ..... A42B 1/004 2/206
2014/0325727 A1 * 11/2014 Allen ..... A42B 3/20 2/9
2016/0144263 A1 * 5/2016 Sussmann ..... A42B 3/00 2/425
2016/0346662 A1 * 12/2016 Hsu ..... A63B 71/10
2019/0261723 A1 * 8/2019 Hsu ..... A42B 3/20

* cited by examiner

FACEMASK AFFIXED TO A BASEBALL CAP

CROSS REFERENCE TO RELATED APPLICATIONS

This disclosure is a continuation-in-part of U.S. patent application Ser. No. 15/044,724 filed on Feb. 16, 2016 which is a continuation-in-part of U.S. patent application Ser. No. 13/948,973 filed on Jul. 23, 2013 which claims the benefit of U.S. Provisional Application No. 61/674,839 filed on Jul. 23, 2012, all of which are hereby incorporated by reference.

TECHNICAL FIELD

This disclosure is related to decorative apparel related to sporting events. In particular, the disclosure is related to a decorative facemask that can be quickly and easily installed to a bill of a baseball cap.

BACKGROUND

The statements in this section merely provide background information related to the present disclosure. Accordingly, such statements are not intended to constitute an admission of prior art.

Facemasks are used in sports to protect the face from impact. For example, football helmets and catcher's masks in baseball are known to include a wire mesh in a crisscross pattern located to the face of the wearer. The wire mesh can be constructed from a metal wire and can be coated with a rubberized or polymer coating. A number of configurations and mesh densities are known for different applications depending upon objects that are expected to come into contact with the facemask and the resulting weight of the facemask.

Facemasks can also include a polymer visor or fitted mask. Hockey goalies may use a hard-shell polymer with holes through which to see and to breathe. Alternatively, modern hockey masks include a hard-shell polymer perimeter with a wire mesh covering an area around the eyes and nose of the goalie. Other hockey players use a clear visor that covers the eyes or the face of the player attached to the helmet of the player. Basketball players can use a nose guard including a polymer fitted to cover at least the nose of the player. Nose guards can include elastic bands connected to the nose guard and configured to wrap around the head of the player to hold the nose guard in place.

Baseball caps include a soft dome or crown configured to fit to and around the top of a person's head. The crown can be made of a plurality of generally triangular shaped panels sown together. Baseball caps also include a bill projecting outward from the front of the crown, the bill extending generally parallel to a direction of forward view of the person wearing the cap. The crown can include an adjustable band in the rear of the crown to make the cap adjustable based upon the head size of the wearer. In another embodiment, the crown can be sized or fitted to a particular head size.

SUMMARY

A one piece plastic decorative facemask decorates the face of a wearer of a ball cap including a bill. The decorative facemask includes a grid portion comprising a plurality of interconnected plastic segments with circular cross sections joined at substantially perpendicular angles, one of the plastic segments forming an upper edge of the grid portion spanning from a distal left side of the grid portion to a distal right side of the grid portion. The decorative facemask further includes an elongated plastic bar spanning the upper edge of the grid portion, is connected to the upper edge of the grid portion at a distal left side of the upper edge of the grid portion and a distal right side of the upper edge of the upper edge of the grid portion, and is unconnected to the upper edge of the grid portion between the distal left side of the upper edge of the grid portion and the distal right side of the upper edge of the upper edge of the grid portion, such that an open slot exists between the elongated bar and the upper edge of the grid portion.

BRIEF DESCRIPTION OF THE DRAWINGS

One or more embodiments will now be described, by way of example, with reference to the accompanying drawings, in which.

DETAILED DESCRIPTION

Figure 1:
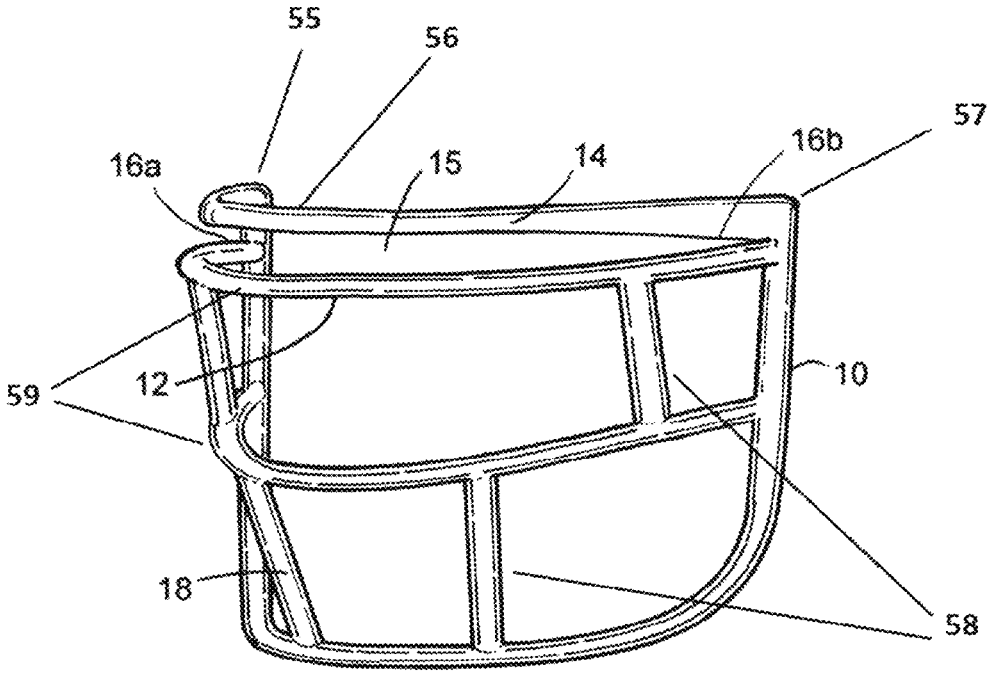
FIG. 1 illustrates an exemplary facemask including a plastic section grid pattern configured to receive and be worn with a ball cap, the facemask configured to imitate a facemask used for a football helmet, in accordance with the present disclosure.

Referring now to the drawings, wherein the showings are for the purpose of illustrating certain exemplary embodiments only and not for the purpose of limiting the same, ball caps are comfortable and widely used. A sports fan can enjoy imitating favorite sports figures. A facemask can be configured to be attached to a ball cap to allow the wearer to imitate the facemask work by the team or player he or she admires.

FIG. 1 illustrates an exemplary facemask including a plastic section grid pattern configured to receive and be worn with a ball cap, the facemask configured to imitate a facemask used for a football helmet. Decorative facemask 10 includes a decorative grid pattern 18 including a plurality of plastic sections configured to imitate a facemask used in a sporting event. Throughout the disclosure, a grid pattern is described as including plastic sections. Plastic sections can include various cross-sectional shapes which can be selected for aesthetic and/or ease of manufacture priorities. Plastic sections can include or be connected to ribs, flat sections, webbing, or other shapes useful, for example, to make the grid pattern stronger or to provide mounting points to fasten the grid to another component according to methods known in the art. Facemask 10 further includes slot 15 configured to receive a bill of a ball cap, such that the wearer of the ball cap has the facemask situated proximate to the face of the wearer. Slot 15 is defined by a lower plastic section 12 and an upper plastic section 14 which are located along an upper edge of the facemask. Slot 15 is further defined by slot end geometries 16*a* and 16*b*, which can be configured to narrow slot 15 at the ends in such a way that a bill inserted within slot 15 is gripped or has an interference fit at slot end geometries 16*a* and 16*b*. Slot 15 and slot end geometries 16*a* and 16*b* are an exemplary embodiment of a bill fastening feature that can be utilized to fasten, affix, or adhere a facemask to a bill of a ball cap. Other embodiments of bill fastening features are envisioned, and the disclosure is not intended to be limited to the examples provided herein.

A facemask including a plastic section grid pattern criss-crossing the face of the wearer is used in numerous sports, including football and baseball. The plastic section grid is sized to permit vision through the plastic section grid while preventing objects used in the sport or activity from directly contacting the face of the wearer. A catcher's mask used in baseball includes a dense pattern of plastic section grid, such that a baseball cannot pass through the grid. Catcher's masks can also include an auxiliary neck guard constructed of a polymer material and configured to hang from the bottom of the facemask to also protect the neck of the wearer. A catcher's mask can be attached to an elastic or fabric retention device configured to hold the mask to the face of the wearer. In another embodiment, a catcher's mask can be attached to a helmet configured to protect the head of the wearer. Football masks are also used. Football masks are connected with brackets or other attachment devices to a football helmet. Instead of a plastic section mesh, a hockey goalie mask or a basketball nose guard can be fitted to the cap similarly with an attached bracket gripping the bill. An imitation or decorative facemask imitating the facemasks worn by athletes can be worn on the baseball cap of sports fans, enabling them to show team spirit or feel more involved in the game.

A decorative facemask can be colored to fit the team colors of a particular team. Team logos can be added. In imitating a catcher's mask, a decorative neck protector known in the art can be hung from the mask.

A decorative facemask can be constructed to fit to the face of a sports fan. While functional facemasks are constructed of rigid material configured to receive impact and protect the face of the user, the primary functions of a decorative facemask are to be in place over the face of the wearer without falling off. A mask with significant weight includes increased force from gravity trying to pull the mask off of the face of the user. Additionally, a mask with significant weight has more mass, and when the user moves his or her head, a header mass will have greater inertia and be more likely to dislodge from the face of the wearer. A light mask without much weight can be used to decorate the face of the wearer and will be easier to retain effectively to the face of the user. Lightweight plastic or polymer materials known in the art can be used to make the mask. According to one embodiment, a polypropylene plastic can be utilized to make the facemask, for example, through an injection molding process. In one exemplary construction, polypropylene/plastic mixture with a hardness of 88 can be utilized.

The decorative facemask 10 of FIG. 1 includes a grid portion which includes plurality of vertical plastic sections 58 and a plurality of horizontal plastic sections 59 which includes lower plastic section 12. Lower plastic section 12 can be said to create an upper edge of the grid portion of facemask 10. Facemask 10 also includes upper plastic section 14 which spans an entire top of the upper edge of facemask 10, from a distal left 55 to a distal right 57.

Facemask 10 includes an arcuate shape configured to keep the plastic sections roughly a same distance away from a face of the user. FIG. 1 illustrates a curved section of the arcuate shape from distal left 55, to center 56, to distal right 57. This concave shape facing the face of the user continues from the top of the facemask to the bottom of the facemask. Each of horizontal plastic sections 59 are curved to match or form the arcuate shape of facemask 10. Vertical plastic sections 59 can be straight or mostly straight. Vertical plastic sections 59 and horizontal plastic sections 58 can be substantially perpendicular to each other.

Figure 2:
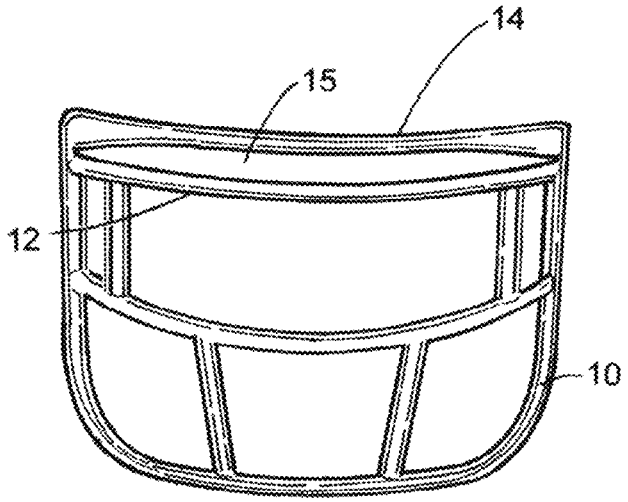
FIG. 2 illustrates another perspective of the facemask of FIG. 1, in accordance with the present disclosure.

FIG. 2 illustrates another perspective of the facemask of FIG. 1. Facemask 10 is illustrated including slot 15 defined by lower plastic section 12 and upper plastic section 14. Slot 15 without a ball cap bill installed can be a straight slot from the illustrated perspective, with curved plastic sections 12 and 14 being situated approximately in parallel to each other.

Figure 3:
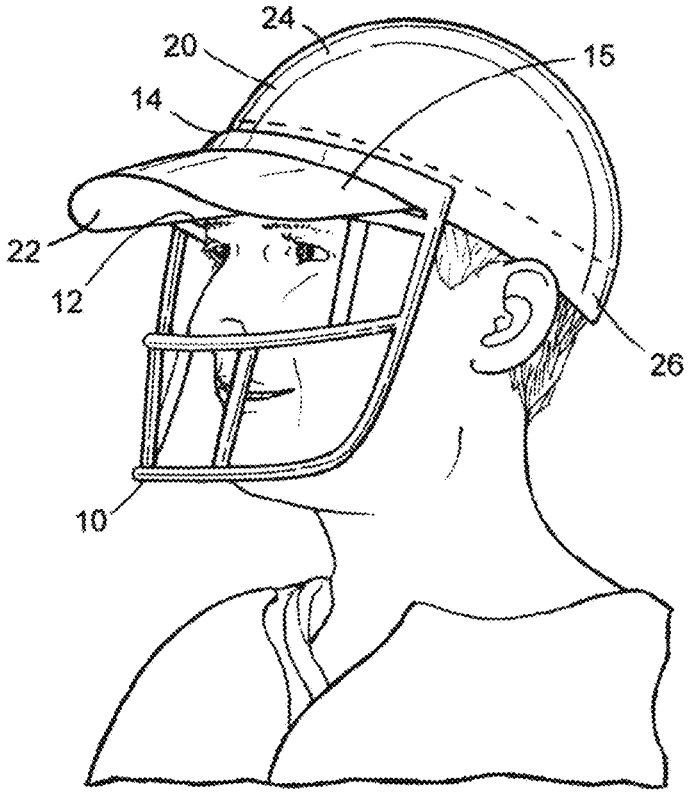
FIG. 3 illustrates an exemplary ball cap with the facemask of FIG. 1 configured thereto, with the facemask being situated to the face of a wearer, in accordance with the present disclosure.

FIG. 3 illustrates an exemplary ball cap with the facemask of FIG. 1 configured thereto, with the facemask being situated to the face of a wearer. Ball cap 20 is illustrated with facemask 10 being installed to bill 22 and situated proximately to the face of a wearer. The facemask can be configured to fit to the face of the user without contacting the face (e.g., the nose or chin of the user) and to not overly obstruct the view of the wearer. Ball cap 20 is illustrated including bill 22, dome 24, and reinforcement band 26. Facemask 10 is illustrated including slot 15 defined by lower plastic section 12 and upper plastic section 14. Bill 22 has been inserted within slot 15 of facemask 10.

Figure 4:
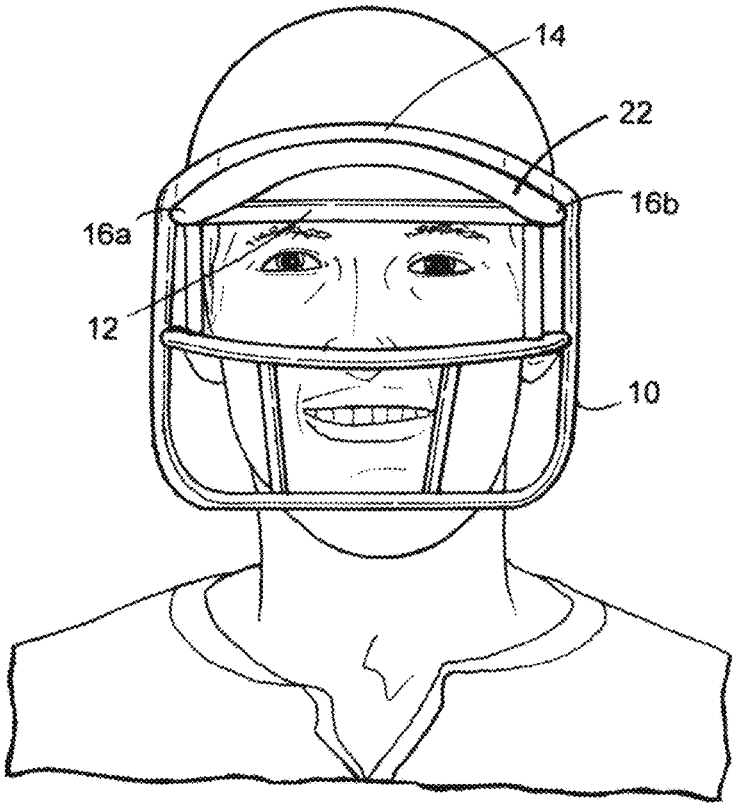
FIG. 4 illustrates another perspective of the ball cap and facemask of FIG. 3, in accordance with the present disclosure.

FIG. 4 illustrates another perspective of the ball cap and facemask of FIG. 3. The ball cap of FIG. 3 including bill 22 is illustrated. Facemask 10 including lower plastic section 12, upper plastic section 14, and slot end geometries 16*a* and 16*b*. One can see that once bill 22 is inserted into the slot between plastic sections 12 and 14, upper plastic section 14 is bent upward. This deformation of plastic section 14 creates a downward force by plastic section 14 upon bill 22, thereby creating a frictional force between the plastic section and the bill acting to hold the facemask in place with relation to the ball cap. Further, the downward force acting upon bill 22 acts to press corners of the bill 22 into slot end geometries 16*a* and 16*b*, increasing a retention force applied to the bill 22 at the slot end geometries 16*a* and 16*b*.

Figure 5:
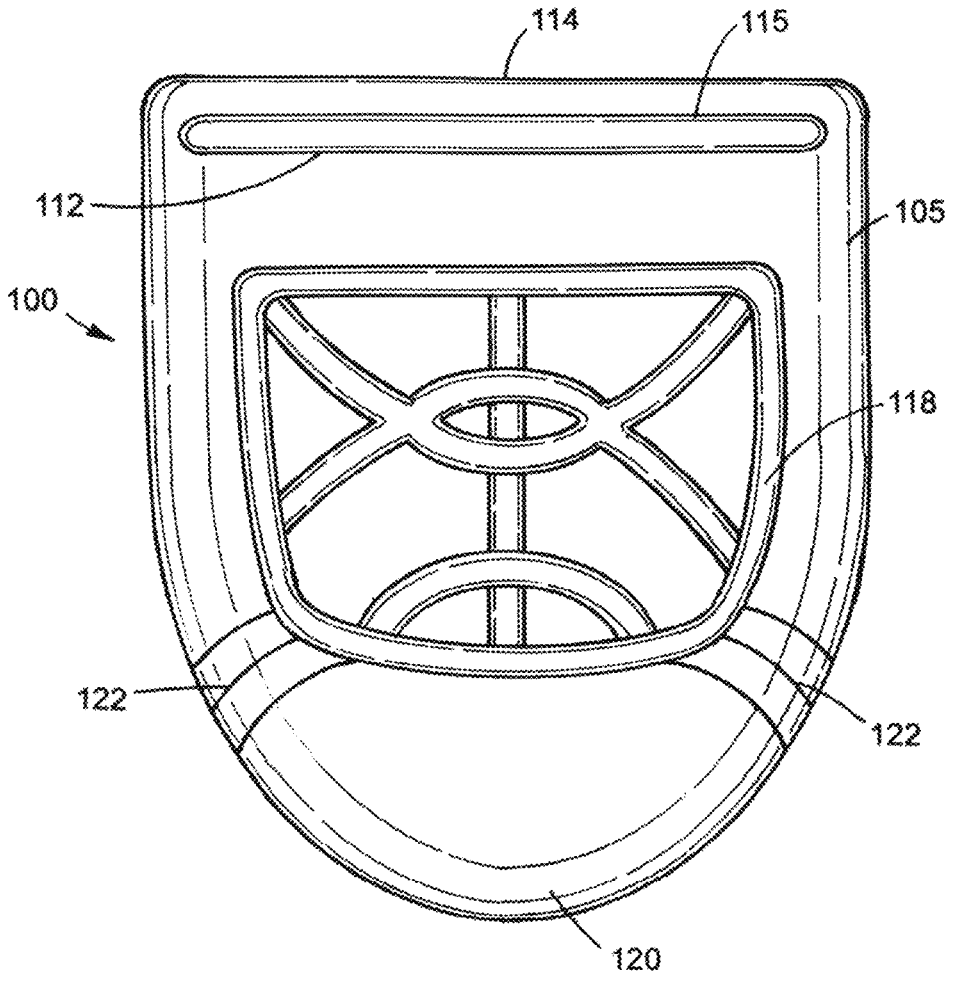
FIG. 5 illustrates an alternative embodiment of a facemask, including a facemask imitating a facemask worn by a hockey goalie, in accordance with the present disclosure.

A number of plastic section grid/grill patterns are known in sports. Many different decorative grid patterns could be utilized on embodiments of the present disclosure. According to the illustrated embodiment of a bill attachment feature, two plastic sections of the facemask form a slot that are used to affix the facemask to the bill of a ball cap. FIG. 5 illustrates an alternative embodiment of a facemask, including a facemask imitating a facemask worn by a hockey goalie. Facemask 100 includes a hard plastic frame 105 that covers an area around a perimeter of facemask 100. Facemask 100 includes an opening in the center of the mask which is covered by a decorative plastic section mesh 118. Facemask 100 includes slot 115 configured to receive a bill of a ball cap, wherein the slot is defined by an upper frame band 114 and a lower slot edge 112. Acting similarly to upper plastic section 14, upper frame band 114 can be configured to bend when a bill is inserted thereto, providing force upon the bill acting to affix facemask 100 to the bill. Slot 115 is configured to be a straight slot with parallel edges, as opposed to the curved slot 15 illustrated in FIG. 2. Different slot configurations with different shapes can work better with different ball cap bill configurations. Slot 15 as illustrated in FIG. 2 can be selected for bills with significant curvature, and slot 115 can be selected for flatter bills. Any of the facemasks disclosed herein can be configured with any slot shape disclosed, and the disclosure is not intended to be limited by the examples provided. Plastic frames or shields on a real hockey mask can be decorated by ornate patterns. A fan may choose to use a facemask 100 with ornamental pattern 122 on frame 105 imitating his or her favorite goalie. Further, a design printed upon exemplary area 120 can be included including a cheer, a team logo, a goalie's name, or other sport oriented ornamentation. An alternative configuration can imitate an older style of hockey facemask including a plastic frame with a hole for each eye of the wearer.

Figure 6:
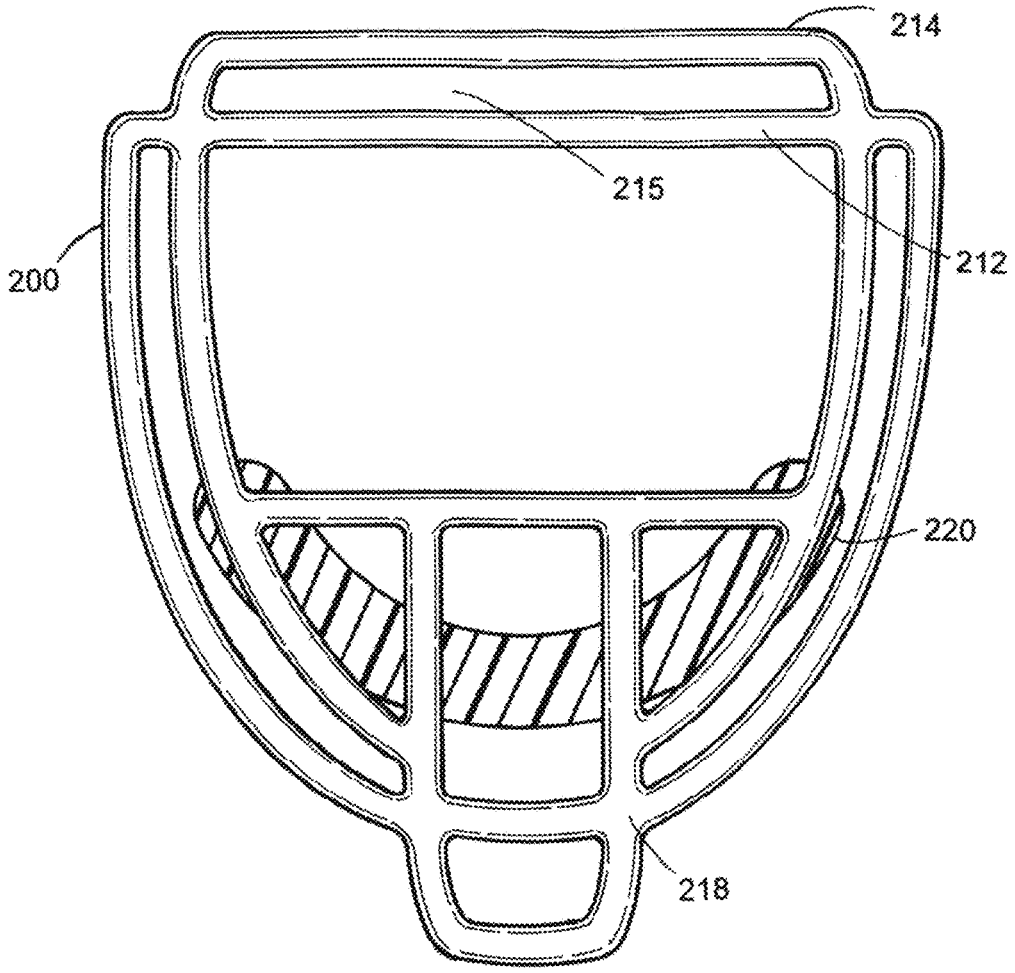
FIG. 6 illustrates an alternative embodiment of a facemask, including a facemask imitating a facemask worn by a baseball catcher, in accordance with the present disclosure.

FIG. 6 illustrates an alternative embodiment of a facemask, including a facemask imitating a facemask worn by a baseball catcher. facemask 200 can be configured similarly to facemask 10, with added features or ornamentation to imitate a facemask worn by a catcher. Plastic section grill pattern 218 can be configured to imitate a facemask configuration worn by catchers known in the art. Additionally, a chin pad 220 can be included on facemask 200 imitating a chin pad that can be worn upon a real catcher's facemask. Facemask 200 include slot 215 defined by lower plastic section 212 and upper plastic section 214 in a configuration similar to slot 15 of FIG. 1. A number of different plastic section configurations imitating facemasks used in different sports are envisioned, and the disclosure is not intended to be limited to the particular examples provided herein.

Figure 7:
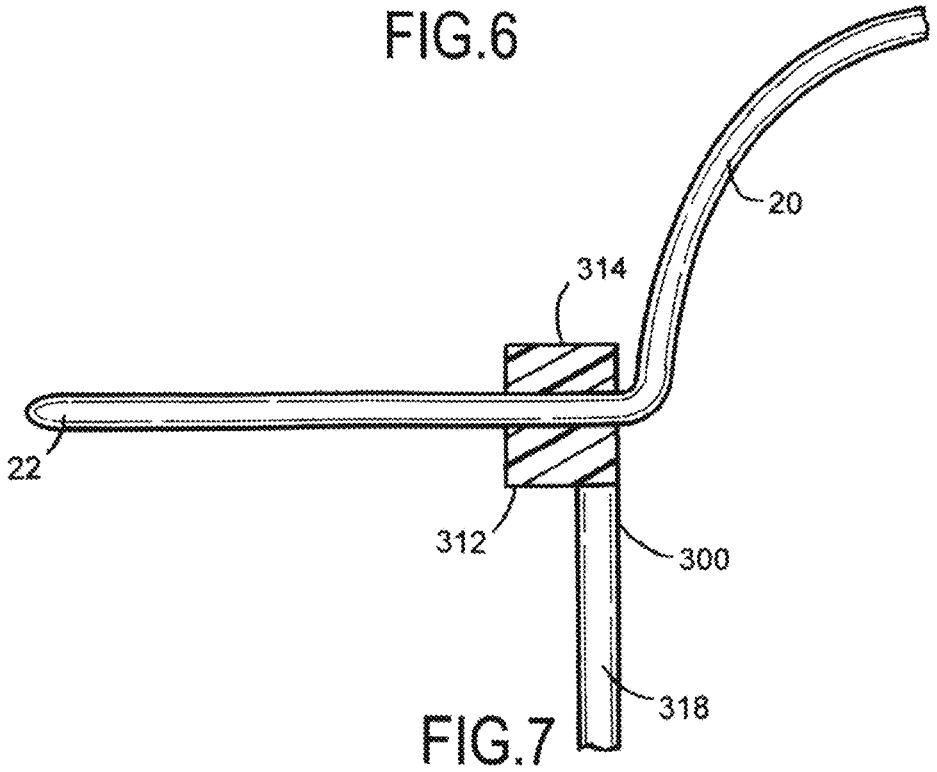
FIG. 7 illustrates an exemplary alternative embodiment of an attachment feature to connect a decorative facemask to a ball cap, in accordance with the present disclosure.

A slot such as is illustrated in the exemplary embodiments of FIG. 1 or FIG. 5 can be utilized as a bill attachment feature as disclosed herein. Other embodiments of bill attachment features are envisioned. FIG. 7 illustrates an exemplary alternative embodiment of a bill attachment feature to connect a decorative facemask to a ball cap. Ball cap 20 including bill 22 is illustrated. A first magnetic feature 312 and a second magnetic feature 314 are illustrated on opposite sides of bill 22 as embodiments of a bill attachment feature, with attraction between the two magnetic features affixing the magnetic features to the bill 22. Any magnetic features can be used. Magnetic features including exemplary rare earth magnets could be used to increase the attractive force or minimize the size of the magnets used. Magnetic feature 212 is attached to facemask 300 including decorative grid pattern 318. A number of other embodiments of bill attachment features are envisioned, for example, buttoning or pinning the facemask to the bill of the ball cap, and the disclosure is not intended to be limited to the examples provided herein.

The facemasks disclosed herein can come in a wide variety of colors. A color can be selected based upon the team local to the region in which the product is being sold. Plastics are known in the art to include a wide variety of dyes and resulting colors. In one embodiment, a swirl pattern can be created in the resulting plastic pieces, such that a team represented by the colors blue and white can be imitated by a facemask using a swirl of blue and white plastics. Decorative tags or stickers could be applied upon a decorative grid pattern, for example, showing a college's mascot. The plastic can be infused with sparkles, or sparkles can be applied to a surface of the plastic to provide a decorative flair to the facemask.

A facemask could include a tab, loop, or other feature permitting the facemask to be stored, for example, on a belt, when the user wants to take a break from wearing the facemask.

Figure 8:
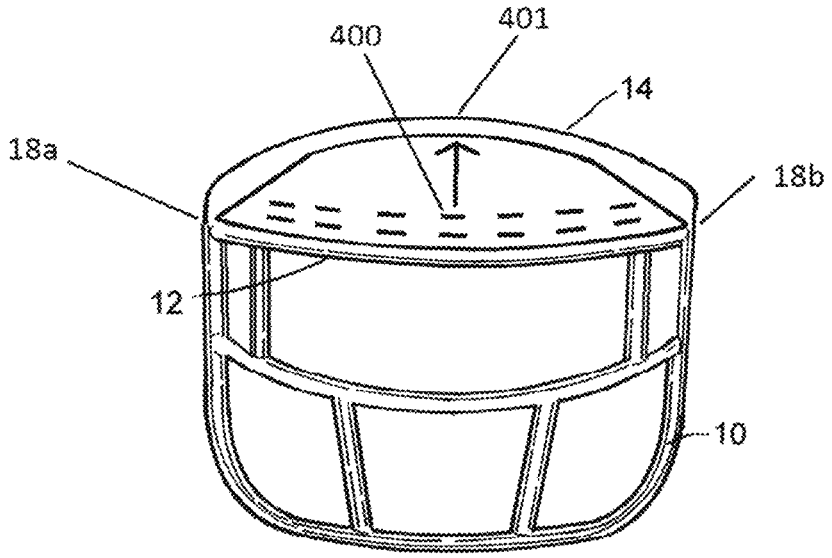
FIG. 8 illustrates the deformation of the facemask of FIG. 4 without the bill inserted for clarity, in accordance with the present disclosure.

As illustrated in FIG. 4, facemask 10 can be held to a bill of a hat solely with the friction created by bending plastic section 14 upward away from the rest of facemask 10. Strain or deformation of the mask creates a force within facemask 10 where plastic section 14 tends to move back toward its original position. FIG. 8 illustrates the deformation of the facemask of FIG. 4 without the bill inserted for clarity. Facemask 10 is illustrated including plastic section 12 and plastic section 14, wherein plastic section 14 is displaced from original position 400 to displaced position 401. Facemask 10 is deformed at joint 18*a* and joint 18*b*, with the plastic being strained at these joints. The force tending to move plastic section 14 back toward the original position creates or increases friction between the bill and the facemask.

Additionally, the plastic sections of facemask 10 are made entirely of plastic (e.g. polypropelene, ABS, or similar polymers.) These polymers are very light as compared to functional facemasks made of metal wire coated with a plastic outer sheathe. Such heavy functional facemasks are commonly held to the face of the user with straps. Facemask 10 can be supported solely by fitting the bill of the hat within the slot of the facemask.

Figure 9:
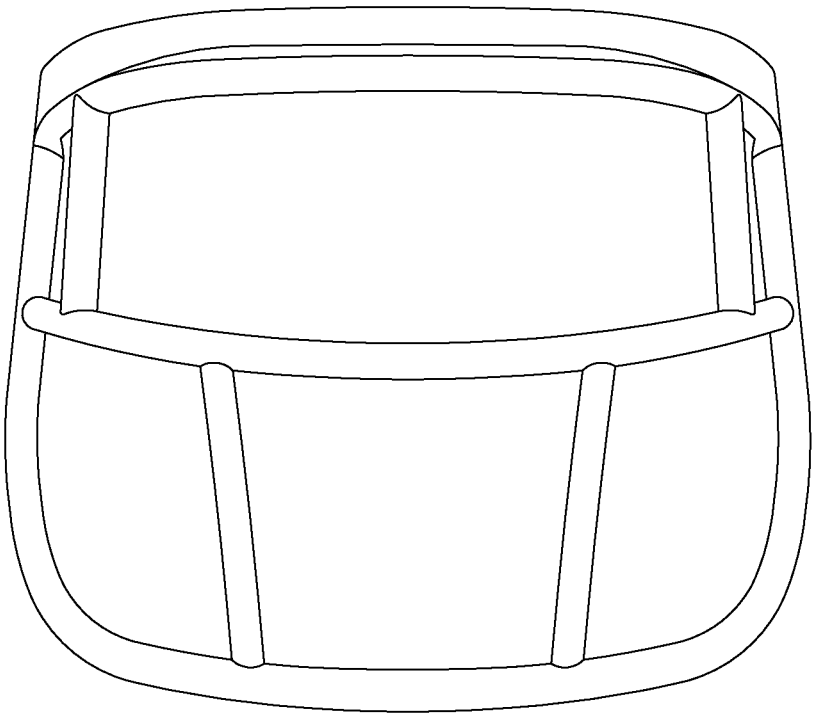
FIG. 9 illustrates photographically an exemplary embodiment of a facemask, including a logo printed upon one of the plastic sections, in accordance with the present disclosure.
Figure 10:
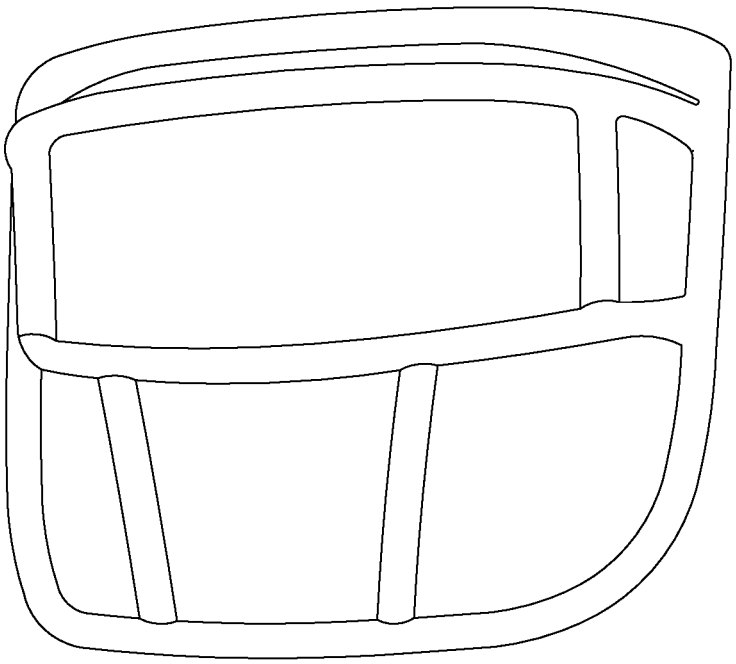
FIG. 10 illustrates photographically an exemplary embodiment of a facemask created in three different colors of plastic, in accordance with the present disclosure.
Figure 11:
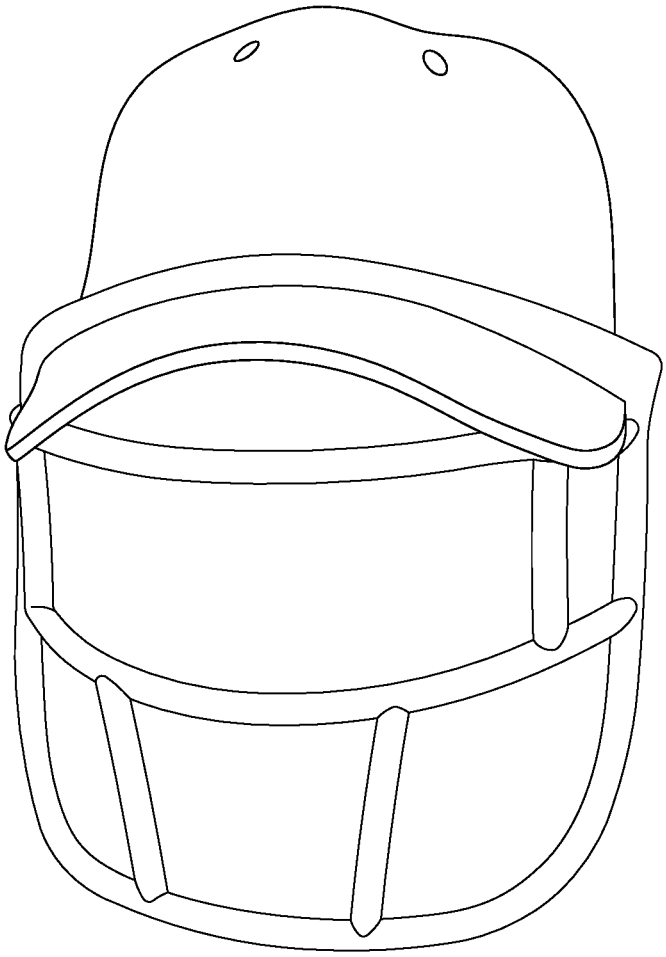
FIG. 11 illustrates photographically an exemplary embodiment of a facemask with a bill of a hat inserted into the slot of the facemask, thereby displacing the top plastic section of the facemask, in accordance with the present disclosure.

FIG. 9 illustrates photographically an exemplary embodiment of a facemask, including a logo printed upon one of the plastic sections. FIG. 10 illustrates photographically an exemplary embodiment of a facemask created in three different colors of plastic. FIG. 11 illustrates photographically an exemplary embodiment of a facemask with a bill of a hat inserted into the slot of the facemask, thereby displacing the top plastic section of the facemask.

According to one embodiment of the disclosure, a facemask is disclosed including a one piece, entirely plastic decorative facemask including a slot formed along a top edge of the facemask configured to receive the bill of a ball cap, wherein the slot is the only or sole attachment feature holding the facemask in place or proximate to the face of the wearer. In saying that the facemask is entirely plastic, one can say that all of the plastic sections of the grid pattern are formed entirely of plastic. Superficial paint, printing, or other decoration could be added to the surface of the disclosed facemask with the facemask still essentially being made entirely of plastic in accordance with the disclosure.

According to another embodiment of the disclosure, a purely decorative facemask useful as a souvenir at a sporting event can be described to be constructed entirely of plastic and include a plurality of interconnected plastic segments with circular cross sections. The decorative facemask includes a grid portion which includes the plurality of interconnected plastic segments which are joined at substantially perpendicular angles. The decorative facemask further includes an elongated bar of plastic spanning an upper edge of the grid portion and is connected to the upper edge at a distal left side and distal right side of the upper edge. Between the distal left side and distal right side, the elongated bar is unconnected to the upper edge of the grid portion, such that an open slot exists between the elongated bar and the upper edge. The open slot is configured to receive the bill of a baseball cap.

According to another embodiment of the disclosure, a purely decorative facemask useful as a souvenir at a sporting event can be described to be constructed entirely of plastic and include a plurality of interconnected plastic segments with circular cross sections. The interconnected plastic segments include a simulated facemask grid portion including plastic segments around a boundary of the grid portion and at least one horizontal plastic segment and a plurality of straight vertical plastic segments within the boundary. The grid portion includes a collectively arcuate shape, with each horizontal plastic segment being similarly curved about the arcuate shape. Additionally, the decorative facemask further includes an elongated plastic bar oriented horizontally and extending from the first, left distal side of a top of the boundary to the second, right distal side of the top of the boundary, wherein the elongated plastic bar is attached to the grid portion at the first, left distal side of the top segment of the boundary and the second, right distal side of the top segment of the boundary with a continuous gap existing between the elongated plastic bar and the grid portion between the first, left distal side of the top segment and the second, right distal side of the top segment, the gap being configured to receive the bill of the cap. In one embodiment, the elongated plastic bar is configured to flex upward when the bill of the cap is inserted within the slot, such that elastic forces within the decorative facemask are configured to affix the decorative facemask to the bill of the cap.

According to another embodiment of the disclosure, a purely decorative facemask useful as a souvenir at a sporting event can be described to be constructed entirely of plastic. The decorative facemask includes a grid portion including a plurality of interconnected plastic bars with circular cross sections, including a boundary made with some of the plastic bars around an outside of the grid portion and a hatch pattern made with a remainder of the plastic bars and including at least one horizontal bar and at least one straight vertical bar within the boundary. The grid portion can include a collectively arcuate shape, with each horizontal plastic segment being similarly curved about the arcuate shape. Additionally, the decorative facemask further includes an elongated plastic segment oriented horizontally and extending from the first, left distal side of a top of the boundary of the grid portion to the second, right distal side of the top of the boundary. The elongated plastic segment is connected to the boundary at two connection points which each can include a small cylindrical plastic section. Between the two connection points, the elongated plastic segment and the top of the boundary are unconnected and form an open slot through which a bill of a hat can be inserted. When the bill of the hat is inserted, the elongated plastic segment is bent upward by elastically stretching the two small cylindrical plastic sections of the two connection points. This elastic stretching is maintained so long as the bill of the hat remains in the slot and causes the decorative facemask to grip to the bill of the hat.

According to another embodiment of the disclosure, a purely decorative facemask useful as a souvenir at a sporting event can be described as a one piece plastic decorative facemask made entirely of plastic including a grid portion constructed of a plurality of cylindrically-shaped sections. The grid portion includes a boundary of the grid portion including a top segment of the boundary including a horizontally oriented first of the cylindrically-shaped sections, and a second of the cylindrically-shaped sections extending downwardly from a first, left distal side of a top segment of the boundary, extending horizontally, and extending upwardly to a second, right distal side of the top segment of the boundary. The grid portion further includes a pattern of the grid portion within the boundary of the grid portion including a remainder of the cylindrically-shaped sections. The decorative facemask further includes an elongated plastic bar oriented horizontally and extending from the first, left distal side of the top segment of the boundary to the second, right distal side of the top segment of the boundary, wherein the elongated plastic bar is attached to the grid portion at the first, left distal side of the top segment of the boundary and the second, right distal side of the top segment of the boundary with a continuous gap existing between the elongated plastic bar and the grid portion between the first, left distal side of the top segment and the second, right distal side of the top segment, the gap being configured to receive the bill of the cap. The elongated plastic bar is configured to elastically deform into a bent state when the bill is inserted within the gap, the elongated plastic bar in the bent state being configured to provide a gripping force upon the bill of the cap.

The plastic bars or plastic segments of the decorative facemask can be alternatively described as interconnected plastic cylinders forming a hatched grid pattern similar to an American football facemask.

Figure 12:
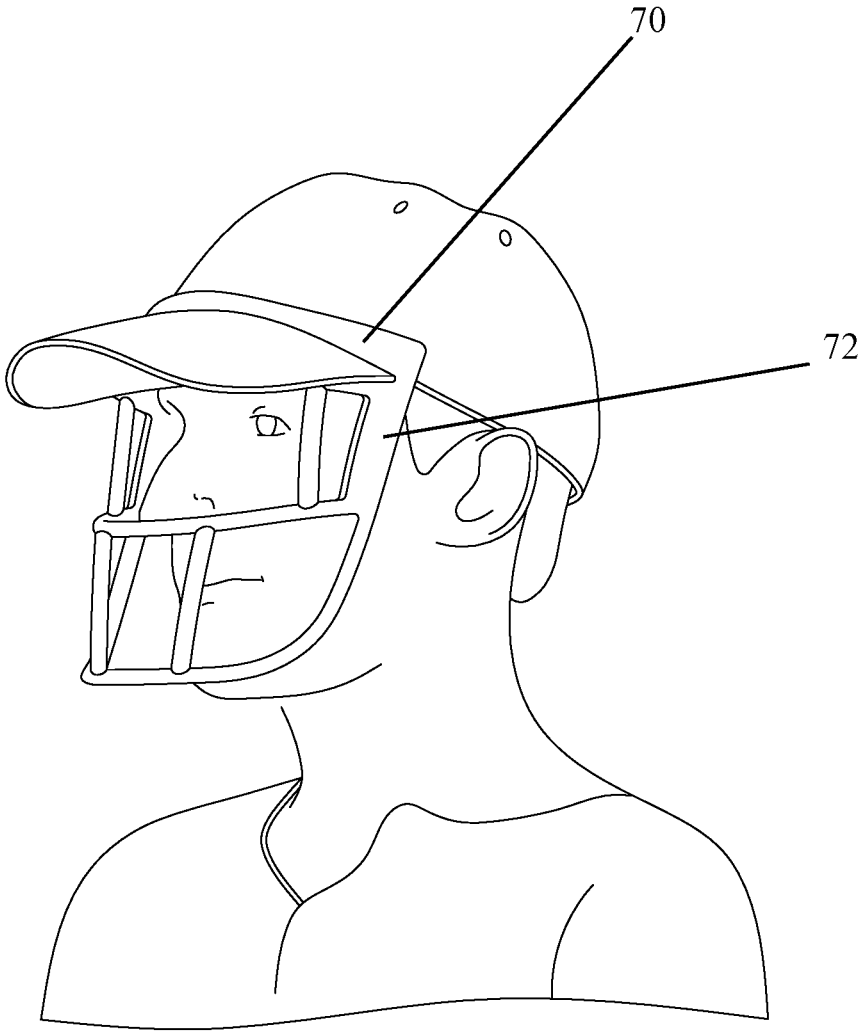
FIG. 12 photographically illustrates an exemplary decorative facemask worn by a user, in accordance with the present disclosure.

FIG. 12 photographically illustrates an exemplary decorative facemask worn by a user. Decorative facemask 70 is an alternative embodiment to facemask 10 of FIG. 1 and includes a reinforcement rib 72 on each side of the facemask, preventing deformation of the upper plastic section to insert the bill of the hat from deforming plastic sections of the grid portion.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A combination apparatus consisting of:

a cap including a soft dome including panels sewn together and a bill;

a one-piece decorative facemask constructed entirely of plastic, comprising:

a grid portion comprising a plurality of interconnected vertical plastic segments and horizontal plastic segments, wherein a top one of the horizontal plastic segments forms an upper edge of the grid portion spanning from a distal left side of the grid portion to a distal right side of the grid portion;

an elongated plastic bar, connected to the upper edge of the grid portion at a distal left side of the upper edge of the grid portion and a distal right side of the upper edge of the grid portion, and wherein a continuous slot is defined between the bar and the upper edge of the grid portion between the distal left side of the upper edge of the grid portion and the distal right side of the upper edge of the grid portion, wherein the bill of the cap is received in the continuous slot with the distal left side and the distal right side of the upper edge engaging the bill.

2. The combination apparatus of claim 1, wherein the decorative facemask has an arcuate shape, including the plurality of horizontal plastic segments.

3. The combination apparatus of claim 2, wherein the vertical plastic segments of the facemask are straight.

4. The combination apparatus of claim 1, wherein the decorative facemask further comprises:

a first connection point between the upper edge of the grid portion and the elongated plastic bar at the distal left side of the upper edge of the grid portion; and a second connection point between upper edge of the grid portion and the elongated plastic bar at the distal right side of the upper edge of the grid portion.

5. The combination apparatus of claim 4, wherein the first connection point and the second connection point each comprise a cylindrical plastic section.

6. The combination apparatus of claim 1, wherein the continuous slot includes two narrowed portions at each end of the continuous slot that are narrowed to grip the bill.

7. The combination apparatus of claim 1, wherein the decorative facemask further comprises:

a first connection point between the upper edge of the grid portion and the elongated plastic bar at the distal left side of the upper edge of the grid portion;

a second connection point between upper edge of the grid portion and the elongated plastic bar at the distal right side of the upper edge of the grid portion; and reinforcement ribs provided below each of the connection points.

8. Apparatus including a ball cap including a bill including a soft dome made from panels sewn together, in combination with a one-piece facemask, the apparatus comprising:

the one-piece facemask having an arcuate shape and being constructed entirely of plastic, consisting of:

a grid portion including a plurality of vertical plastic segments and a plurality of horizontal plastic sections, wherein the vertical plastic segments and the horizontal plastic are joined together, the plurality of vertical plastic sections include at least one straight vertical plastic segment;

wherein the horizontal plastic segments are curved to form the arcuate shape of the facemask in the horizontal direction, one of the horizontal plastic segments forming an upper edge of the grid portion spanning from a distal left side of the grid portion to a distal right side of the grid portion; and an elongated plastic bar spanning the upper edge of the grid portion, wherein the bar is connected to the upper edge of the grid portion at a distal left side of the upper edge of the grid portion and a distal right side of the upper edge of the grid portion, wherein the upper edge of the grid portion and the bar define an open slot between the distal left side of the upper edge of the grid portion and the distal right side of the upper edge of the grid portion, wherein the bill of the ball cap is received in the open slot, with the distal left side and the distal right side of the upper edge engaging the bill, and wherein the bill disposed in the slot connects the one-piece facemask to the ball.

9. A combination apparatus consisting of:

a cap including a soft, adjustable dome and a bill configured to extend above and in front of a user's face; and a facemask including a plastic grid having a plurality of interconnected vertical segments and horizontal segments, and an upper bar connected to an uppermost horizontal segment of the grid, wherein the upper bar is attached at a distal right side and a distal left side of the uppermost horizontal segment, wherein a slot is defined by the upper bar and the uppermost horizontal segment between the distal right side and the distal left side, and wherein the bill is received in the slot and friction between the upper bar and the uppermost horizontal segment is applied to the bill and solely holds the facemask on the bill of the cap.

* * * * *